US008991407B2

(12) United States Patent
Zhang

(10) Patent No.: US 8,991,407 B2
(45) Date of Patent: Mar. 31, 2015

(54) ACTUATABLE COSMETIC DEVICE

(75) Inventor: Derik Zhang, Liaobu Town (CN)

(73) Assignee: Lava Industries, Inc., Monterey Park, CA (US)

( * ) Notice: Subject to any disclaimer, the term of this patent is extended or adjusted under 35 U.S.C. 154(b) by 6 days.

(21) Appl. No.: 13/135,797

(22) Filed: Jul. 15, 2011

(65) Prior Publication Data

US 2013/0014778 A1 Jan. 17, 2013

(51) Int. Cl.
*A45D 33/20* (2006.01)
*A45D 33/00* (2006.01)

(52) U.S. Cl.
CPC ..... *A45D 33/008* (2013.01); *A45D 33/20* (2013.01)
USPC ..... 132/287; 132/294

(58) Field of Classification Search
USPC ..... 132/287, 293–307; 206/581, 823; 401/118, 123, 125
See application file for complete search history.

(56) References Cited

U.S. PATENT DOCUMENTS 1,446,779 A * 2/1923 Abrahams ..... 132/297
1,666,116 A * 4/1928 Bunnell ..... 401/10
2,547,971 A * 4/1951 Polin et al. ..... 132/297
5,301,808 A * 4/1994 Pierson ..... 206/581
5,483,981 A * 1/1996 Vandromme et al. ..... 132/315
6,298,863 B1 * 10/2001 Byun ..... 132/294
7,083,354 B2 * 8/2006 Byun ..... 401/263
7,140,372 B2 * 11/2006 Byun ..... 132/287
7,350,525 B2 * 4/2008 Delage ..... 132/293
2002/0162566 A1 * 11/2002 Jang ..... 132/294
2003/0154996 A1 * 8/2003 Bourjal ..... 132/293
2004/0173234 A1 * 9/2004 Byun ..... 132/287
2004/0200497 A1 * 10/2004 Thorpe et al. ..... 132/287
2004/0206370 A1 * 10/2004 Byun ..... 132/287
2004/0221866 A1 * 11/2004 Greenfield ..... 132/287
2005/0011806 A1 * 1/2005 Byun ..... 206/581
2005/0081877 A1 * 4/2005 Byun ..... 132/294
2005/0172981 A1 * 8/2005 Byun ..... 132/287
2007/0056603 A1 * 3/2007 Huh ..... 132/294
2014/0284334 A1 * 9/2014 Crapet et al. ..... 220/324

* cited by examiner

*Primary Examiner* — Rachel Steitz
*Assistant Examiner* — Jennifer Gill
(74) *Attorney, Agent, or Firm* — William W. Haefliger

(57) ABSTRACT

In cosmetic equipment, the combination comprising, a support receptacle containing a chamber, a cosmetic device at least partly concealed in stored position in the chamber, a pusher to controllably displace the device from stored position so that at least a portion of the device protrudes from the chamber and is presented for use, a handle carried by and movable relative to the support receptacle to controllably displace the pusher.

13 Claims, 5 Drawing Sheets

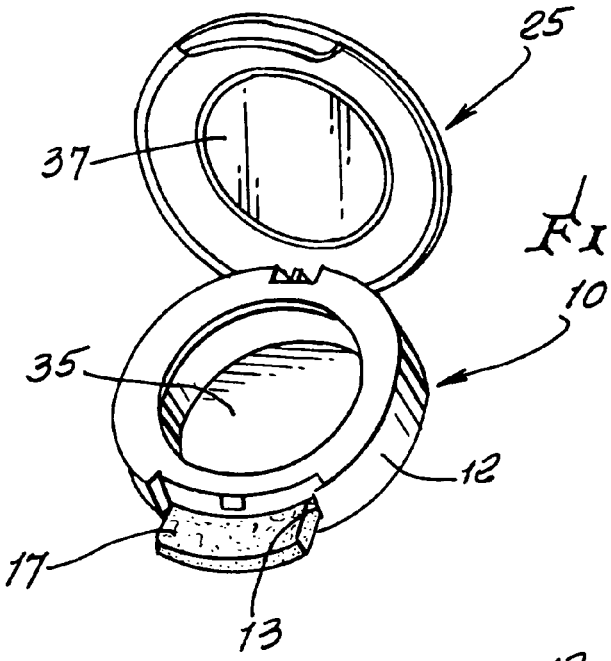
FIG. 1
FIG. 2
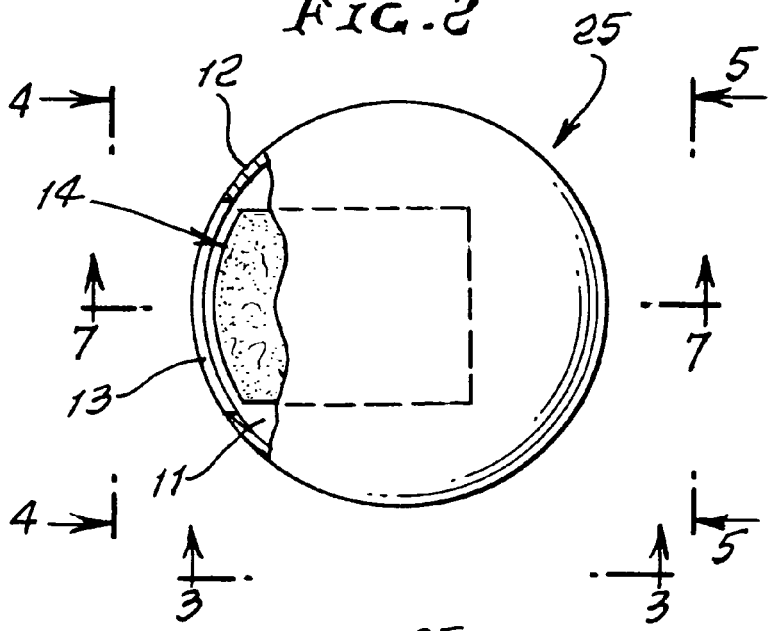
FIG. 3
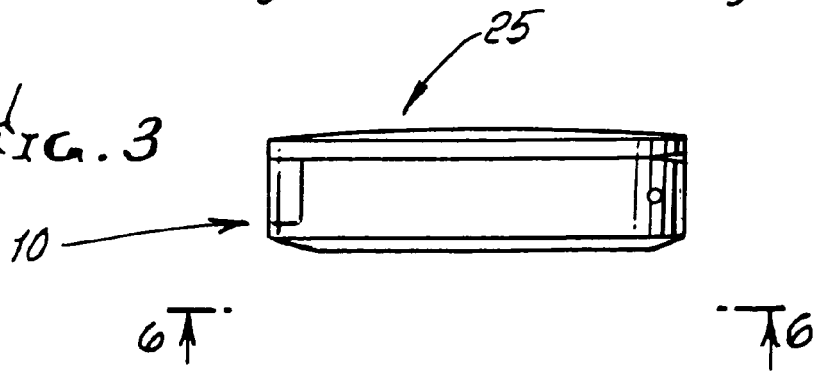

ACTUATABLE COSMETIC DEVICE

BACKGROUND OF THE INVENTION

This invention relates generally to beauty products, and more specifically to cosmetic related products that can be stored in a user's hand bag or purse.

There is need for improvements in such products such as support receptacles that are easily operable to controllably and movably present useful articles, particularly in such manner that the articles are retained or partly retained by the receptacles. There is also need for such products having the improvements in construction, modes of operation, and unusually beneficial results as are disclosed herein.

SUMMARY OF THE INVENTION

It is a major object of the invention to provide easily manipulable relatively movable elements defining such improvements. Basically, a beauty product, as for example cosmetic equipment, embodying the invention comprises in combination:

a) a support receptacle containing a chamber, b) a cosmetic device at least partly concealed in stored position in the chamber, c) a pusher to controllably displace the device from stored position so that at least a portion of the device protrudes from the chamber and is presented for use, d) a handle movable carried by and movable relative to the support receptacle to controllably displace the pusher.

Typically, the handle has a first position collapsed relative to the support receptacle and a displaced position or position in which the handle projects away from the support and the pusher has been controllably displaced; and the handle is pivotally carried by the support receptacle to conform in configuration to that of the receptacle in handle closed position.

Another object is to provide a device carried by the support receptacle to be displaced endwise from stored position to use position as the handle is manually pivoted. That device may comprise a cosmetic sponge or tray to be advanced and retracted relative to the support receptacle, in response to handle pivoting.

Yet another object comprises provision of the handle in the form of a cover configured to fit the support receptacle.

A further object includes provision of handle and pusher cam surfaces to engage and be relatively displaced, as the handle is pivoted.

An added object is to provide a mirror carried by the handle to become exposed as the handle is provided.

These and other objects and advantages of the invention, as well as the details of an illustrative embodiment, will be more fully understood from the following specification and drawings, in which:

DRAWING DESCRIPTION

FIG. 1 is a perspective view of one form of equipment embodying the invention, and in handle pivoted and actuating position;

FIG. 2 is an enlarged top plan view of the FIG. 1 equipment, in closed position;

FIG. 3 is a side elevation view taken on lines 3-3 of FIG. 2;

FIGS. 9-13 are views showing modifications.

DRAWING DESCRIPTION

Figure 4:
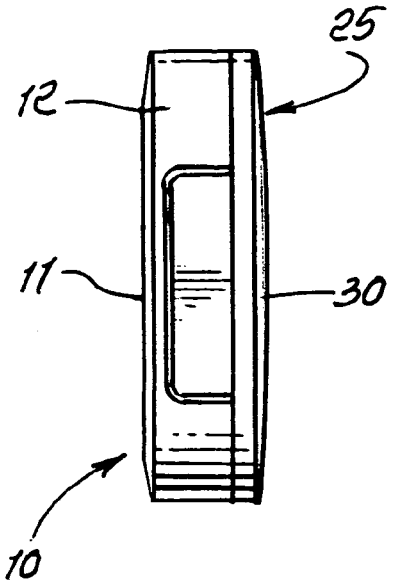
FIG. 4 is a side elevation view taken on lines 4-4 of FIG. 2.
Figure 5:
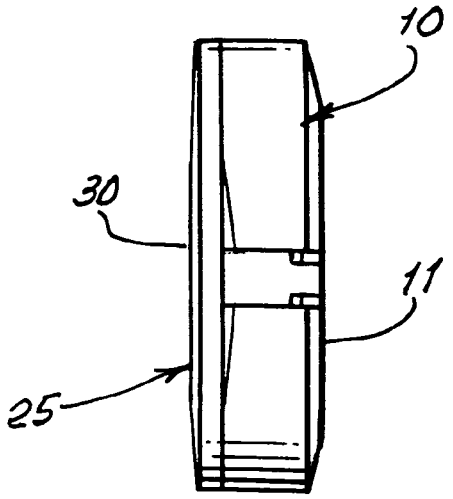
FIG. 5 is a side elevation view taken on lines 5-5 of FIG. 2.
Figure 6:
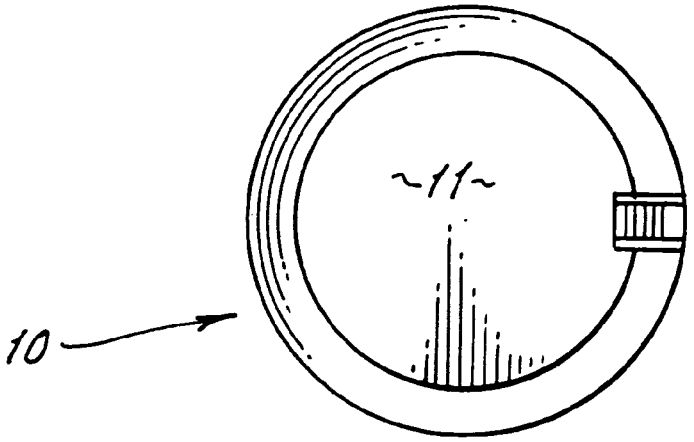
FIG. 6 is a bottom plan view taken on lines 6-6 of FIG. 3.

In the drawings, showing a preferred form of the invention, a support receptacle or case 10, which may be circular, includes a bottom wall 11, and a generally circular side wall 12 having a front opening 13. A slider or carrier 14 is located next to wall 11, to slide back and forth (see arrows 15 and 16) to advance and retract a cosmetic device 17, as for example a sponge or tray. The slider may define a tray 18. Device 17 has a fully stored position in receptacle interior chamber 19, as in FIG. 7, and an advanced or partly projected position seen in FIG. 8. See projected forward extent 17*a* of the sponge. See also rearward extent 17*b* of the sponge, remaining in chamber 19 and supported on the slider, which remain concealed. This enables guided, assured reception of the sponge back into FIG. 7 position after sponge use, the rearward 17*c* end of the sponge engaging slider end wall 14*b*, to correctly endwise position the sponge for full retraction into stored position, as the slider retracts. Also, the used extent 17*a* of the removed sponge can be re-inserted first after positioning, so that the un-used extent of the sponge 17*aa* will be first projected by the slider, upon subsequent sponge projection into FIG. 8 position.

Figure 10:
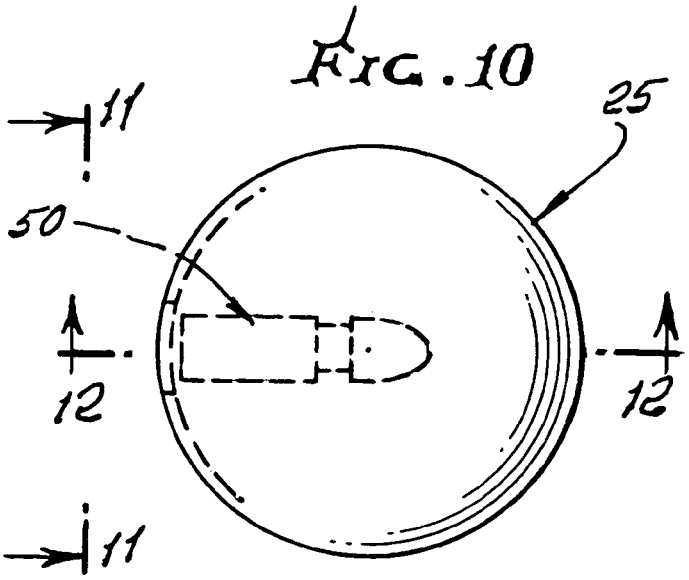
FIG. 10 is a top plan view of the FIG. 9 device.
Figure 11:
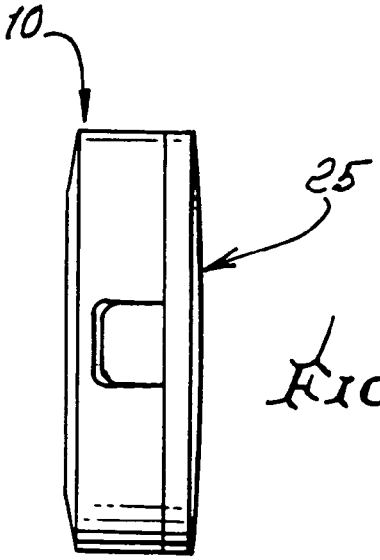
FIG. 11 is a side view taken on lines 11-11 of FIG. 10.
Figure 12:
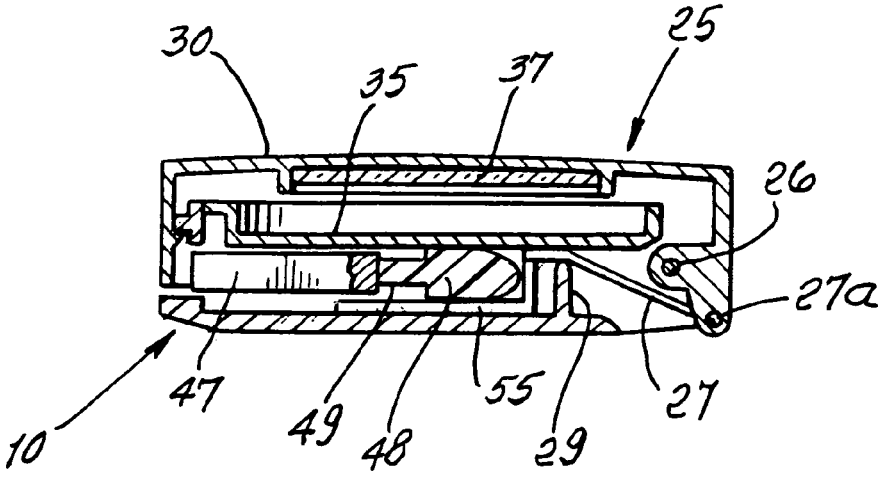
FIG. 12 is a view like FIG. 7, showing a modification.
Figure 13:
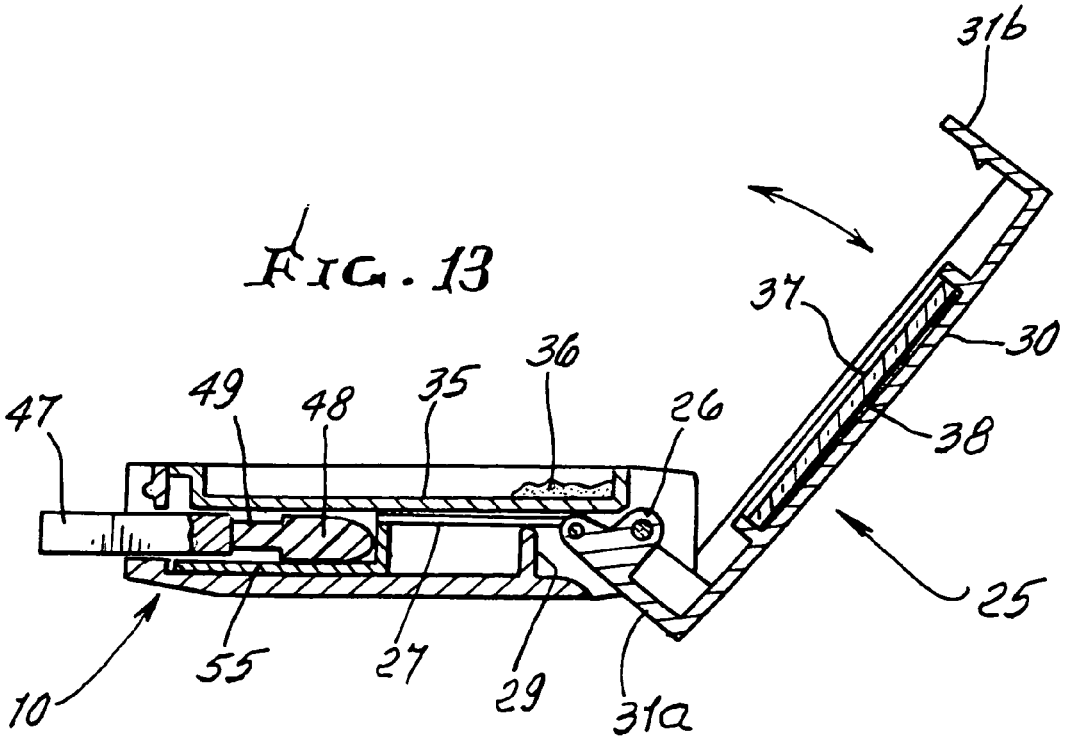
FIG. 13 is a view like FIG. 8, showing a modification.

The slider may be regarded as a lower tray to carry cosmetics material (powder, rouge, etc.) in the zone defined by the sponge. FIGS. 10 and 11 show the substitution of a cosmetics applicator 50, for the sponge. FIGS. 12 and 13 show substitution of a combined sponge 47 and cosmetic applicator 48, endwise connected at 49. A lower tray 55 is seen in Fig 13, as well as upper tray 35.

Figure 7:
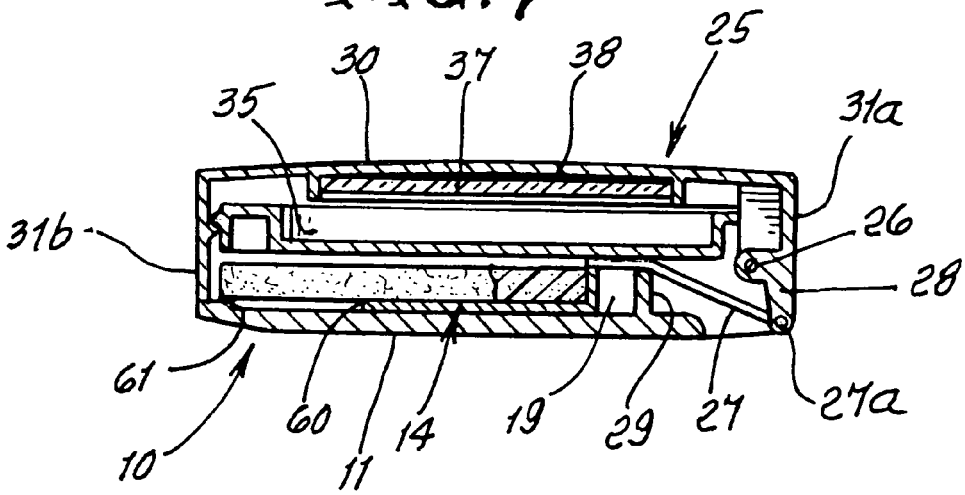
FIG. 7 is an enlarged section taken on lines 7-7 of FIG. 2.
Figure 8:
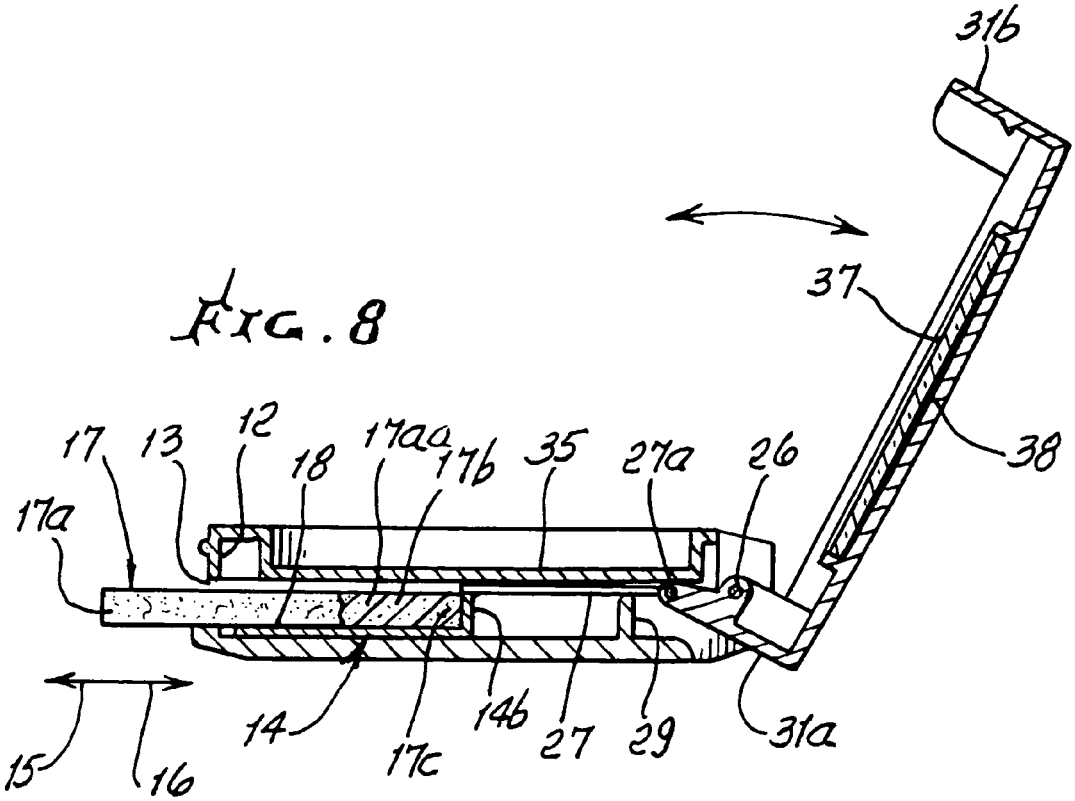
FIG. 8 is an enlarged view, like FIG. 7, but showing the configuration and position of movable elements, after handle pivoting to FIG. 1 open position.
Figure 9:
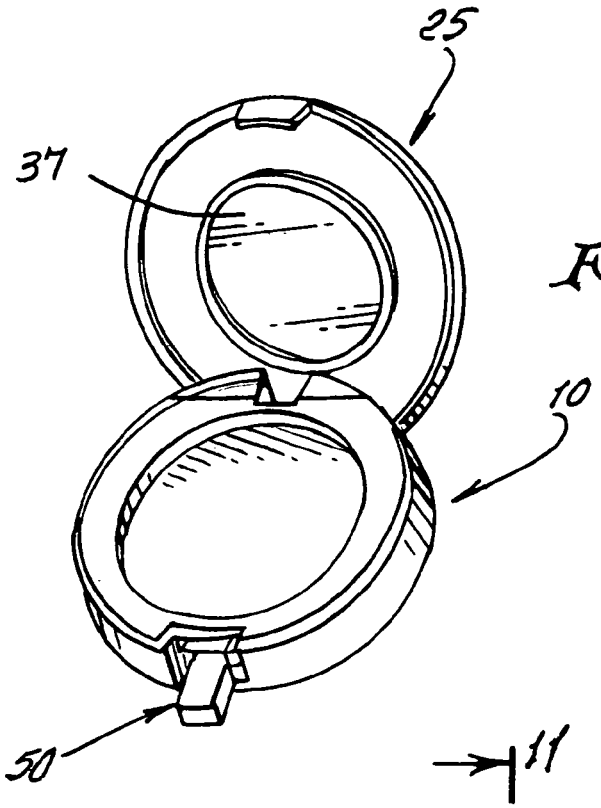
FIG. 9 is a view like FIG. 1 showing a modification.

Also provided is a handle 25 in the form of a lever pivoted at 26 to the receptacle, to swing between FIG. 7 (closed) position, and FIG. 8 (open) position. A stiff, yet bendable elongated connector or pusher 27 extends between a swingable locus 27*a* on tang or arm 28 integral with the lever, and the slider end wall 14*a*, to effect slider movement endwise, as the handle 25 is swung between its FIGS. 12 and 13 positions. A guide projection 29 integral with bottom wall 11, guides endwise movement of the connector 27. The handle includes top wall or cover 30 and end walls 31*a* and 31*b*, that fit over opposite ends of the receptacle, as in FIGS. 7 and 12, to conform the handle to the receptacle container shape, to readily fit in a hand bag or purse.

FIGS. 8 and 13 also show a cosmetic top tray 35 extending over the sponge or applicator in the receptacle. Tray 35 may contain cosmetic substance 36 that does not spill. Also, FIG. 13 shows provision of a mirror 37 attached at 38 to the inner side of the handle. See also FIG. 8.

A stop 60 on the slider engages the receptacle at 61 to limit forward positioning of device 17.

The invention also provides multiple highly advantageous sponge use position, as follows:

i) a fully stored position in the receptacle, the handle being closed onto the receptacle, ii) a partly endwise exposed position in which one end of the sponge projects from the receptacle with the sponge endwise positioned by the slider, iii) a partly endwise exposed and replaced position in which the opposite end of the sponge projects from the receptacle and said one end of the sponge, with soils therein, is received on the slider, in the receptacle, iv) a fully stored position with both ends of the sponge stored in the receptacle said soiled one end of the sponge completely concealed.

I claim:

1. A cosmetic compact comprising, in combination:

a) a support receptacle containing a chamber, b) a cosmetic device at least partly concealed in a stored position in the chamber, c) a pusher to controllably displace the cosmetic device horizontally and linearly from the stored position, so that at least a portion of the cosmetic device protrudes from the chamber and is presented for use, d) a handle carried by and movable relative to the support receptacle to controllably displace the pusher, in an endwise generally linear direction, e) and wherein the pusher includes a bendable connector everywhere linearly elongated, in said linear direction, there being a guide projection integral with the support receptacle and over which the connector extends and over which the connector increasingly bodily bends during endwise displacement of the cosmetic device toward the stored position, f) wherein the handle has a first pivoted position collapsed relative to the support receptacle and a second displaced or extended position in which the handle projects away from the support receptacle and the pusher has been controllably bodily displaced endwise by the handle pivoting to displace the cosmetic device, and wherein the handle is pivotally carried by the support receptacle at a first pivot locus, and the pusher's elongated bendable connector is connected to the handle at a second and swingable locus spaced from said first pivot locus, to endwise displace said connector and the cosmetic device in opposite and endwise directions as said second locus is bodily swung in an opposite direction about said first locus in response to the handle pivoting, a major extent of the connector being bent sidewardly away from said first pivot locus and relative to said guide projection in response to pivoting of the handle toward the support receptacle, the entirety of said connector at all positions of said bodily displacement thereof, consisting of a first unidirectional segment extending and movable lengthwise linearly in a first direction, and of a second unidirectional segment extending and movable lengthwise linearly in a second direction, wherein said first and second directions meet at a single bend of said connector formed on said guide projection, as the connector travels over said guide projection, the pusher at all times remaining positively connected to the handle at said second locus, g) the entirety of said connector at all positions of said bodily displacement thereof consisting of a first and straight unidirectional segment extending and movable lengthwise linearly in the first direction which is the direction of said linear movement of the slider, and of a second unidirectional segment extending and movable lengthwise linearly in the second direction, wherein said first and second directions meet at a connector single bend formed sideward of and on said guide projection, as the connector travels over said guide projection, said second unidirectional segment formed between said bend and said second locus whereby the length of said second segment is redirected as the handle is moved toward a closed position.

2. The combination of claim 1 wherein the handle closely fits adjacent the support receptacle in said first position.

3. The combination of claim 1 wherein the cosmetic device is carried by the support receptacle to be displaced endwise relative to the support from the stored position to the use position as the handle is manually pivoted.

4. The combination of claim 3 wherein said cosmetic device includes a sponge slidably carried by the support receptacle.

5. The combination of claim 4 wherein only one forward end portion of the sponge projects from the support receptacle upon displacement.

6. The combination of claim 4 wherein the sponge has multiple positions that include the following:

i) a fully stored position in the support receptacle, the handle being closed onto the support receptacle, ii) a partly endwise exposed position in which one end of the sponge projects from the support receptacle with the sponge endwise positioned by the slider, that carries the sponge, iii) a partly endwise exposed position in which an opposite end of the sponge projects from the support receptacle and said one end of the sponge, with soils therein, is received on the slider, in the support receptacle, iv) a fully stored position with both ends of the sponge stored in the support receptacle, said soiled end of the sponge completely concealed.

7. The combination of claim 5 wherein the slider has a stop to limit sponge endwise positioning in the slider.

8. The combination of claim 3 wherein the cosmetic device includes a cosmetic tray slidably carried by the support receptacle.

9. The combination of claim 1 wherein the handle has the form of a cover configured to fit the support receptacle.

10. The combination of claim 9 including a mirror carried by the handle to be exposed as the handle is pivoted.

11. The combination of claim 1 wherein g) said guide projection is integral with the support receptacle and has sideward linearly progressive engagement with the connector along its length, so that the connector has an extent that remains aligned with the direction of pusher travel as the handle is swung away from the support receptacle.

12. The combination of claim 1 including a mirror carried by the handle to overlie said cosmetic device in the closed position of the handle.

13. A cosmetic compact comprising in combination:

a) a manually manipulable device that includes b) a housing and a slider slidably supported by the housing to carry a cosmetic device in a support receptacle, c) a tray supported by the housing to extend above the slider, d) a cover carried by the housing to extend above the tray when the cover is moved into a closing position, e) and a mirror carried by the cover to extend over the tray, f) the slider and cover having interconnection characterized as effecting linear movement of the slider as said interconnection swings about a cover pivot location, g) said interconnection including a linearly elongated bendable connector that engages and increasingly bends over and against the projecting end of a guide projection, during endwise displacement of the device toward a stored position, h) a major extent of the connector being bent away and displaced sidewardly from the cover when the cover is moved into the closing position, i) and wherein the cover has a first pivoted position collapsed relative to the support receptacle and a second displaced or extended position in which the cover projects away from the support receptacle and the pusher has been controllably bodily displaced endwise by the cover pivoting to displace the cosmetic device, and wherein the cover is pivotally carried by the support receptacle at a first pivot locus, and the pusher elongated bendable connector is connected to the cover at a second and swingable locus spaced from said first pivot locus, to endwise displace said connector and said cosmetic device in opposite and endwise directions as said second locus is bodily swung about said first locus in response to the cover pivoting, the major extent of the connector being bent sidewardly away from said first pivot locus and relative to said guide projection in response to pivoting of the cover toward the support receptacle, the entirety of said connector at all positions of said bodily displacement thereof consisting of a first and straight unidirectional segment extending and movable lengthwise linearly in a first direction, which is the direction of said linear movement of the slider, and of a second unidirectional segment extending and movable lengthwise linearly in a second direction, wherein said first and second directions meet at a connector single bend formed sideward of and on said guide projection, as the connector travels over said projection, said second unidirectional segment formed between said bend and said second locus whereby a length of said second segment is reduced as the cover is moved toward the closing position.

* * * * *